US007448393B2

(12) United States Patent
Beak

(10) Patent No.: US 7,448,393 B2
(45) Date of Patent: Nov. 11, 2008

(54) COSMETIC BRUSH

(76) Inventor: Woon Beak, 101-208, Yeonghwachammaeum Apt., 1-1, Yeowol-dong, Ojeong-gu, Gyeonggi-do, Bucheon-si (KR)

( * ) Notice: Subject to any disclaimer, the term of this patent is extended or adjusted under 35 U.S.C. 154(b) by 18 days.

(21) Appl. No.: 11/548,857

(22) Filed: Oct. 12, 2006

(65) Prior Publication Data

US 2007/0183834 A1 Aug. 9, 2007

(30) Foreign Application Priority Data

Feb. 9, 2006 (KR) ..... 1020060012324
Aug. 30, 2006 (KR) ..... 1020060082713

(51) Int. Cl.
*A45D 40/26* (2006.01)
*A46B 11/00* (2006.01)

(52) U.S. Cl. ..... 132/218; 401/129

(58) Field of Classification Search ..... 132/218, 132/317, 320; 401/127, 126, 129
See application file for complete search history.

(56) References Cited

U.S. PATENT DOCUMENTS 2,195,472 A * 4/1940 Ladislaus et al. ..... 132/317
3,694,096 A * 9/1972 Seidler ..... 401/127
5,121,763 A * 6/1992 Kingsford ..... 132/317
6,799,582 B2 * 10/2004 Kim ..... 132/317
7,172,357 B2 * 2/2007 Gueret ..... 401/129
2007/0204872 A1 * 9/2007 Kee ..... 132/218

* cited by examiner

*Primary Examiner*—Robyn Doan
(74) *Attorney, Agent, or Firm*—Cantor Colburn LLP

(57) ABSTRACT

A cosmetic brush which includes a cylindrical cap, a supporting tube mounted inside, of the cap, an upright-standing stem movably received in the tube, and a cosmetic container. A tuft of bristles is fixed on a lower end of the stem. A spring is disposed inside of the cap such that the stem is biased downwardly inside of the tube. The stem has a latching protrusion and the tube has a guide slit to receive the latching protrusion. The downward movement of the stem is stopped by the guide slit when the tuft of bristles is exposed outside of the tube. When the supporting tube is inserted into the container, the latching protrusion is latched and pushed upwards by the top opening of the container, thereby allowing the stem and the tuft of bristles to be raised so as to be received inside of the tube.

4 Claims, 9 Drawing Sheets

COSMETIC BRUSH

BACKGROUND OF THE INVENTION

1. Field of the Invention

The present invention relates to a cosmetic brush in which a stem is vertically formed at a cap screw-engaged with a cosmetic container, and more particular, to a cosmetic brush in which a tuft of bristles automatically gets in and out of the inside of a supporting tube by rotating the cap so as to be screw-engaged or screw-disengaged with/from the container, so that problems such as bending or spreading of the tuft of bristles and the like generated due to its twist can be prevented when rotating the tuft of bristles in a liquid cosmetics having high-viscosity.

2. Background of the Related Art

In general, in case of make-up with liquid cosmetic products such as lip gross, mascara, eye liner, and nail varnish by using a cosmetic brush, as a cap mounted at an upper portion of the stem where a tuft of bristles is implanted is screw-engaged with a cosmetic container, a user can conveniently carry the liquid cosmetic product in a state where the stem and the tuft of bristles is kept in the cosmetic container. If necessary, the user can apply make-up with the cosmetic brush stained with liquid cosmetics after removing the cap from the cosmetic container.

In the prior art, however, when the tuft of bristles is rotated in the liquid cosmetics having a high-viscosity upon screw-coupling the cap and the cosmetic container with each other, the tuft of bristles is twisted and tangled due to the resistance against the liquid cosmetics.

Consequently, since a user cannot properly apply make-up to where the liquid cosmetic is needed with the tangled bristles, it causes a waste of the liquid cosmetic due to the tangled bristles, and also a refined make-up is not operated.

The tendency of development of various liquid cosmetics having a high-viscosity is, especially in the present day, increased and also the liquid cosmetic gains increasing viscosity in proportion to its usage due to the volatilization of the solvent, and hence there is a great need for a cosmetic brush which can minimize the tangle of the bristles thereof.

Further, an inlet of the cosmetic container is coupled to an inner cap thereof having an inlet/outlet hole formed thereon, which is inclined so as to be gradually narrowed in its diameter toward its lower end, and by which the liquid cosmetic stained on the stem is wiped when the stem gets in and out of the inlet/outlet hole.

Thus, since the stem gets in and out of the inlet/outlet hole in such a manner as to be in close contact with the inner circumferential surface thereof, compressed air is produced inside of the container when the stem is inserted into the inlet/outlet hole of the inner cap, such as where a piston is inserted into a cylinder.

Since the pumping effect by which the liquid cosmetic is pushed up is induced by such compressed air, there occurs a problem in that the cap is stained by the liquid cosmetic which flows into the inside of the cap through a gap between the inlet/outlet hole of the inner cap and the stem.

SUMMARY OF THE INVENTION

Accordingly, the present invention has been made to solve the above problems occurring in the prior art, and it is an object of the present invention to provide a cosmetic brush which can prevent problems such as the tangle of the turf of bristles and the like generated due to its twist in a liquid cosmetics having a high-viscosity by automatically being inserted to or removed from the inside of a supporting tube when a cap is screw-engaged and screw-disengaged with/from a cosmetic container, and can increase its convenience in use.

To achieve the above object, according to the present invention, there is provided

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Figure 1:
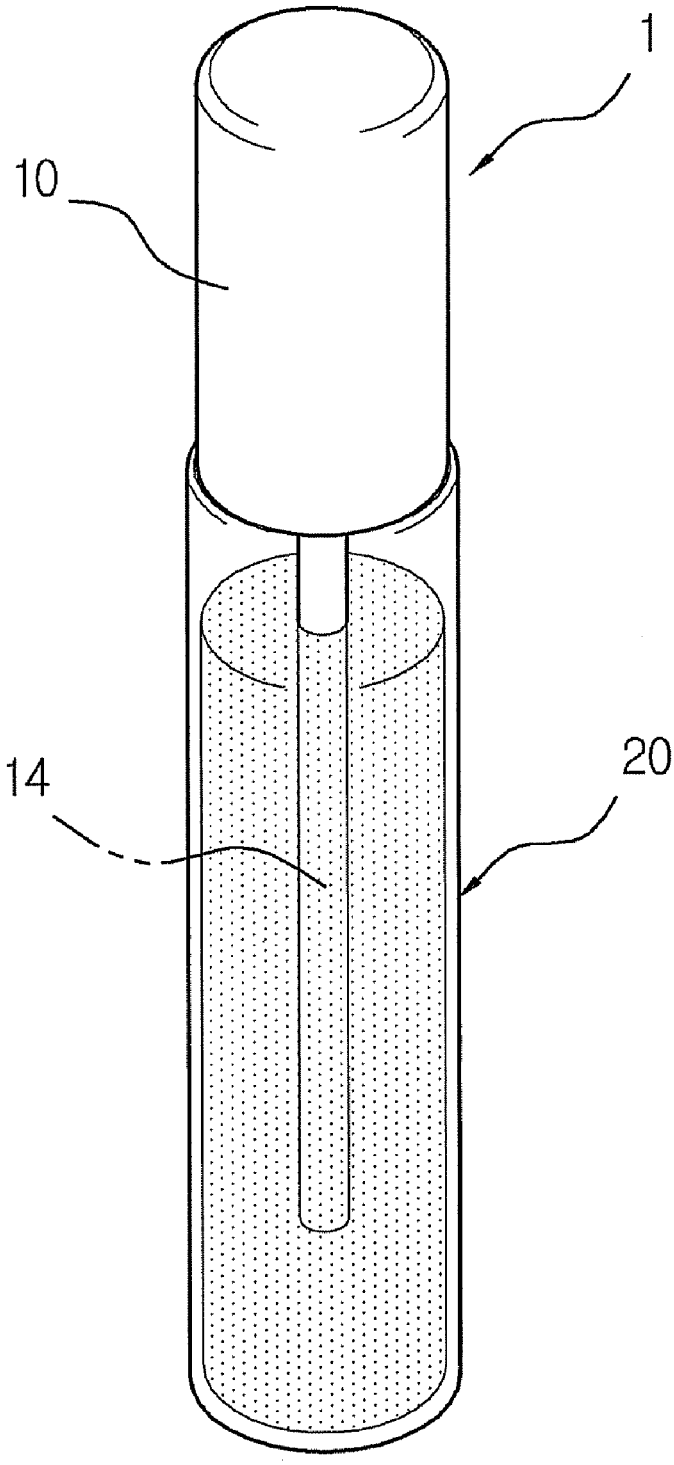
FIG. 1 is a perspective view showing a state where a cosmetic brush according to the present invention is coupled to a cosmetic container.
Figure 2:
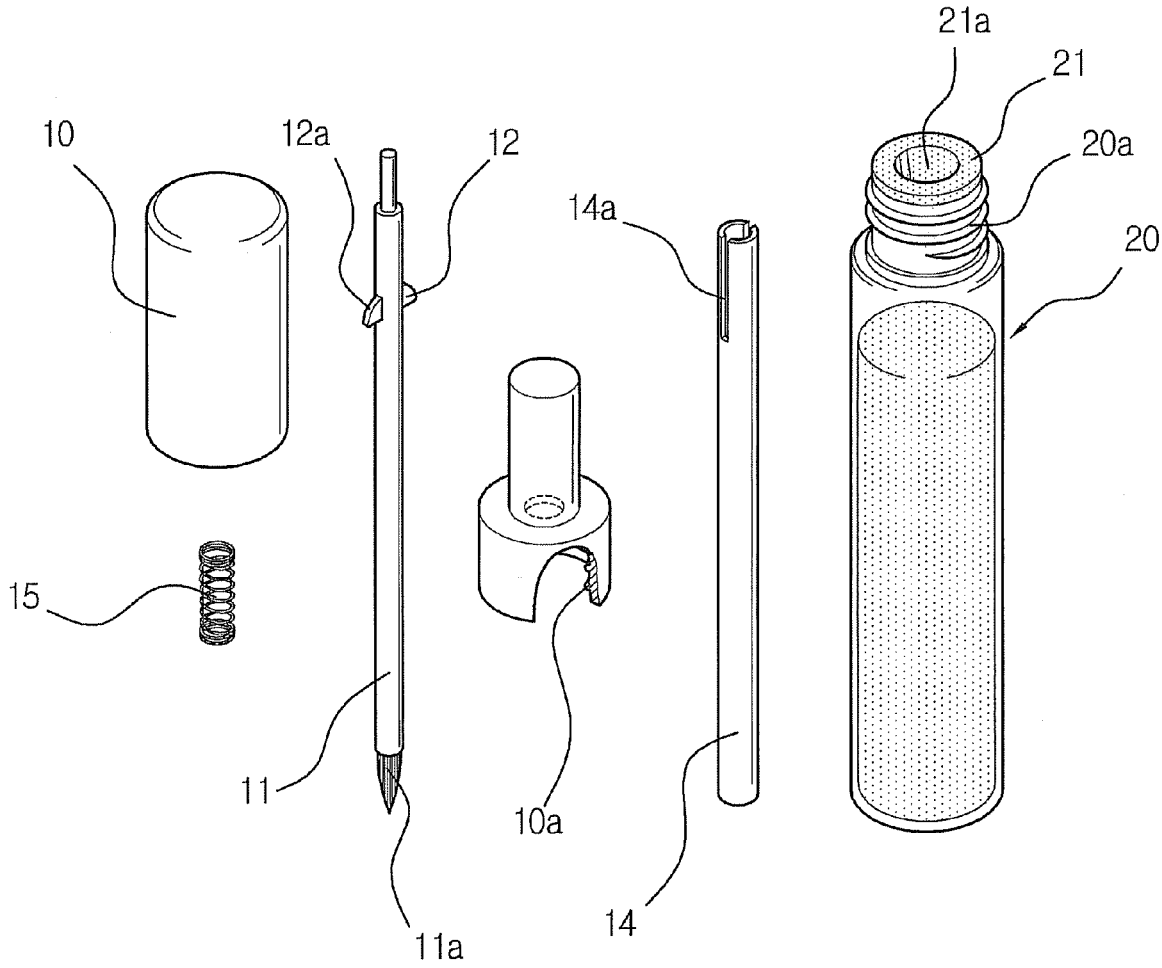
FIG. 2 is an exploded perspective view of a cosmetic brush according to the present invention.

As shown in FIGS. 1 and 2, a cosmetic brush 1 according to the present invention includes a cylindrical cap 10, and a stem 11 implanted with a tuft of bristles 11*a*.

That is, the stem 11 is vertically erected at the inner center of the cylindrical cap 10, and the tuft of bristles 11*a* is fixed on a lower end of the stem 11.

When a screw portion 10*a* formed on an inner peripheral surface of the cap 10 is screw-engaged with a screw portion 20*a* formed on an outer peripheral surface of an inlet of a cosmetic container 20, the stem 11 is inserted through an inlet/outlet hole 21*a* having a narrow width formed on an inner cap 21 of the cosmetic container 20.

Thus, the cosmetic brush 1 is constructed in order to be easily carried in a state where the cap 10 of the cosmetic brush 1 is screw-engaged with the cosmetic container 20 and then the stem 11 and the tuft of bristles 11*a* are received inside of the cosmetic container 20.

Of course, the cosmetic brush 1 as constructed above belongs to a technical spirit, which has been already well known. Nevertheless, the most important feature in configuration of the present invention resides in that the cap 10 is screw-engaged and screw-disengaged with/from the cosmetic container 20 by rotating the cap 10, the tuft of bristles 11*a* automatically gets in and out of the inside of a supporting tube 14, to thereby effectively prevent the tangle of the tuft of the bristles 11*a*.

In other words, the supporting tube 14 is vertically mounted on the center of the inside of the cap 10, and the stem 11 is inserted into the inside of the supporting tube 14.

The stem 11 is elastically supported by a compressed spring 15 of a coil-type mounted to the upper portion of the supporting tube 14, and receives a downward elastic force of the spring 15.

Further, the stem 11 has a latching protrusion 12 formed on both sides of the upper portion thereof, however, of course the latching protrusion 12 may be protrusively formed on a side of the upper portion of the stem 11.

The supporting tube 14 has a guide slit 14*a* formed on the upper portion thereof in such a manner as to be formed long in a lengthwise direction thereof. The guide slit 14*a* is constructed such that the latching protrusion 12 formed on the upper portion of the stem 11 is inserted into the guide slit 14*a* and then the stem 11 together with the latching protrusion 12 is moved within the length of the guide slit 14*a*.

Figure 3A:
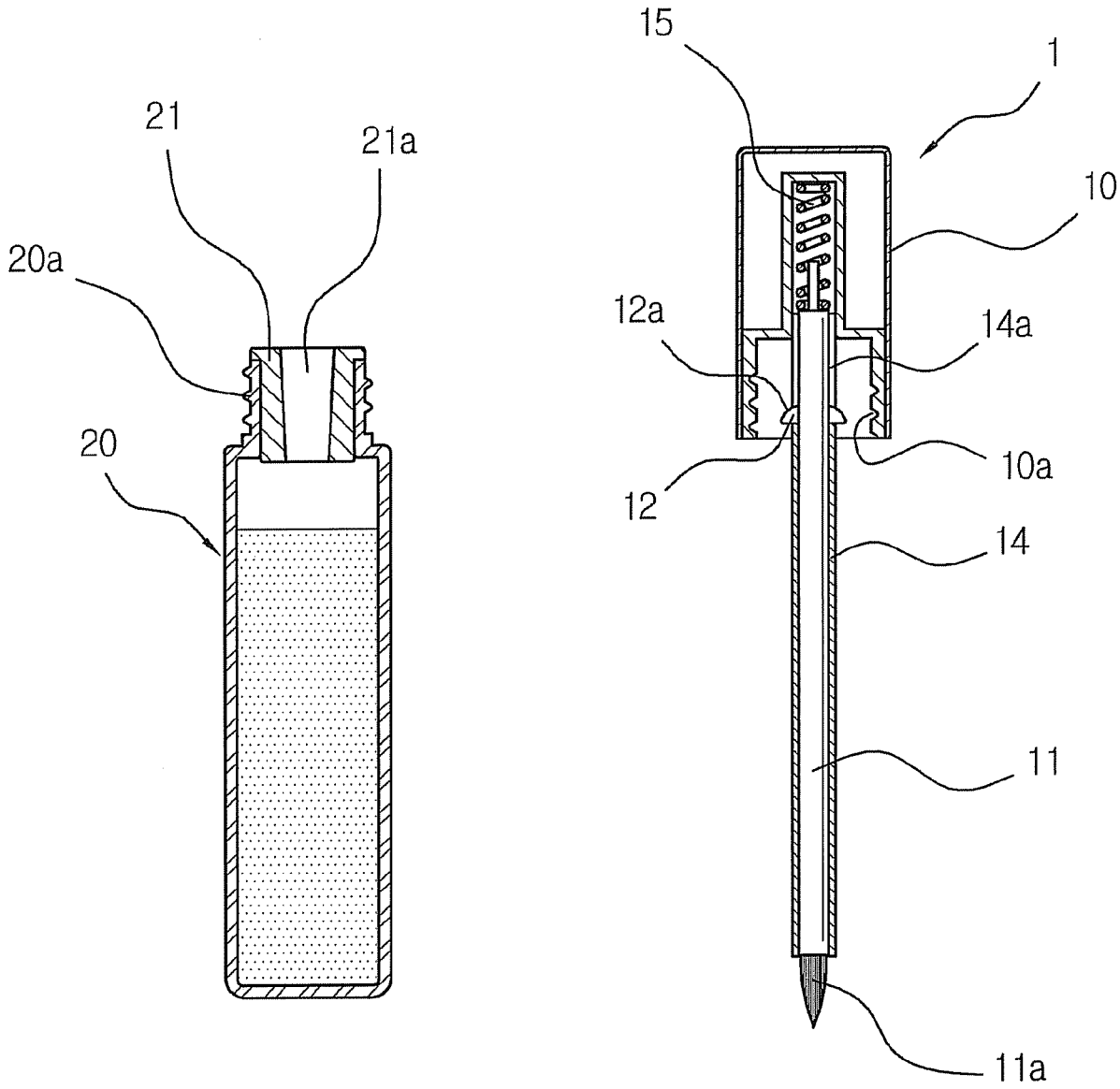
FIGS. 3*a* through 3*c* are cross-sectional views sequentially showing processes for coupling the cosmetic brush to the cosmetic container.

At this time, the latching protrusion 12 together with the stem 11 descends by the elastic force of the spring 15 so as to be latched by a lower end of the guide slit 14*a*, the tuft of bristles 11*a* of the stem 11 is protruded out of the lower portion of the supporting tube 14, to thereby allow a user to apply make-up using the tuft of the bristles 11*a*, and the cap 10 is in a state of being removed from the cosmetic container 20, as shown in FIG. 3*a*.

Figure 3B:
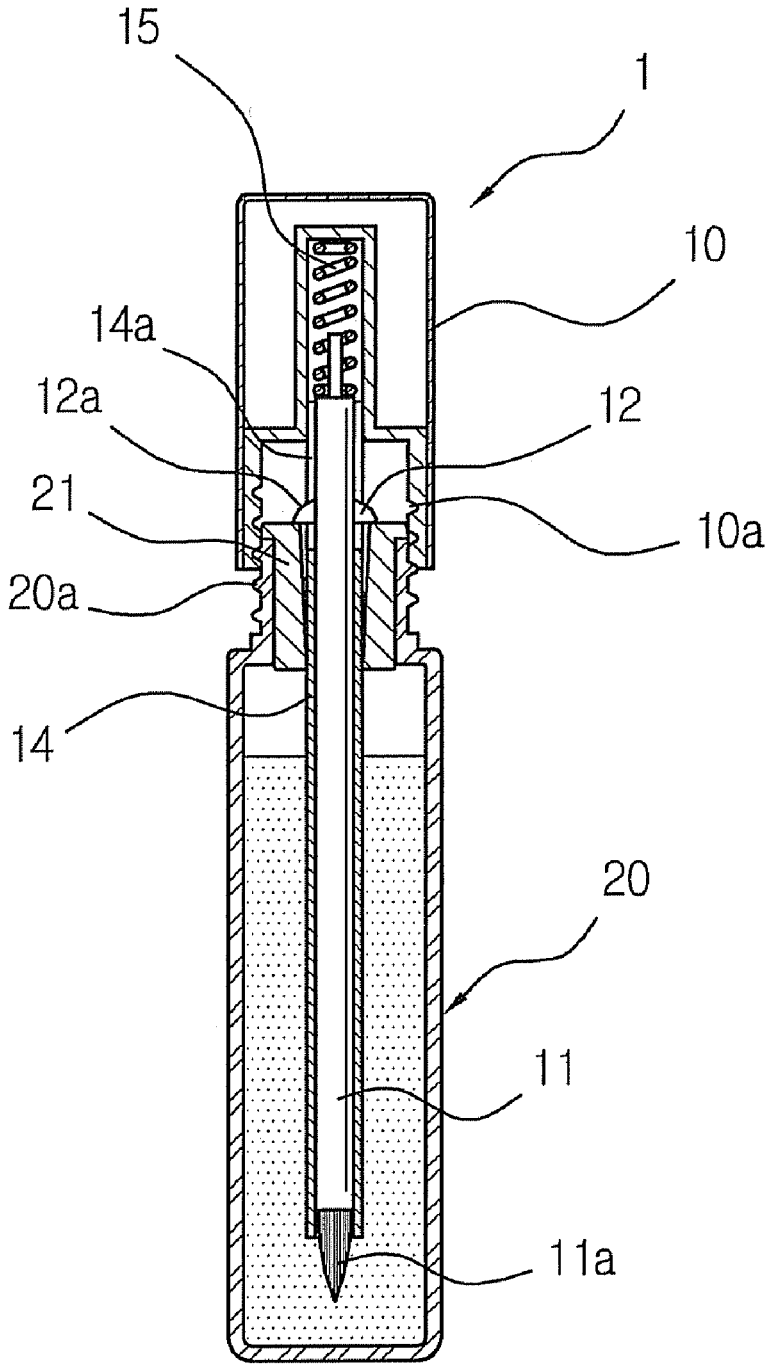
Figure 3C:
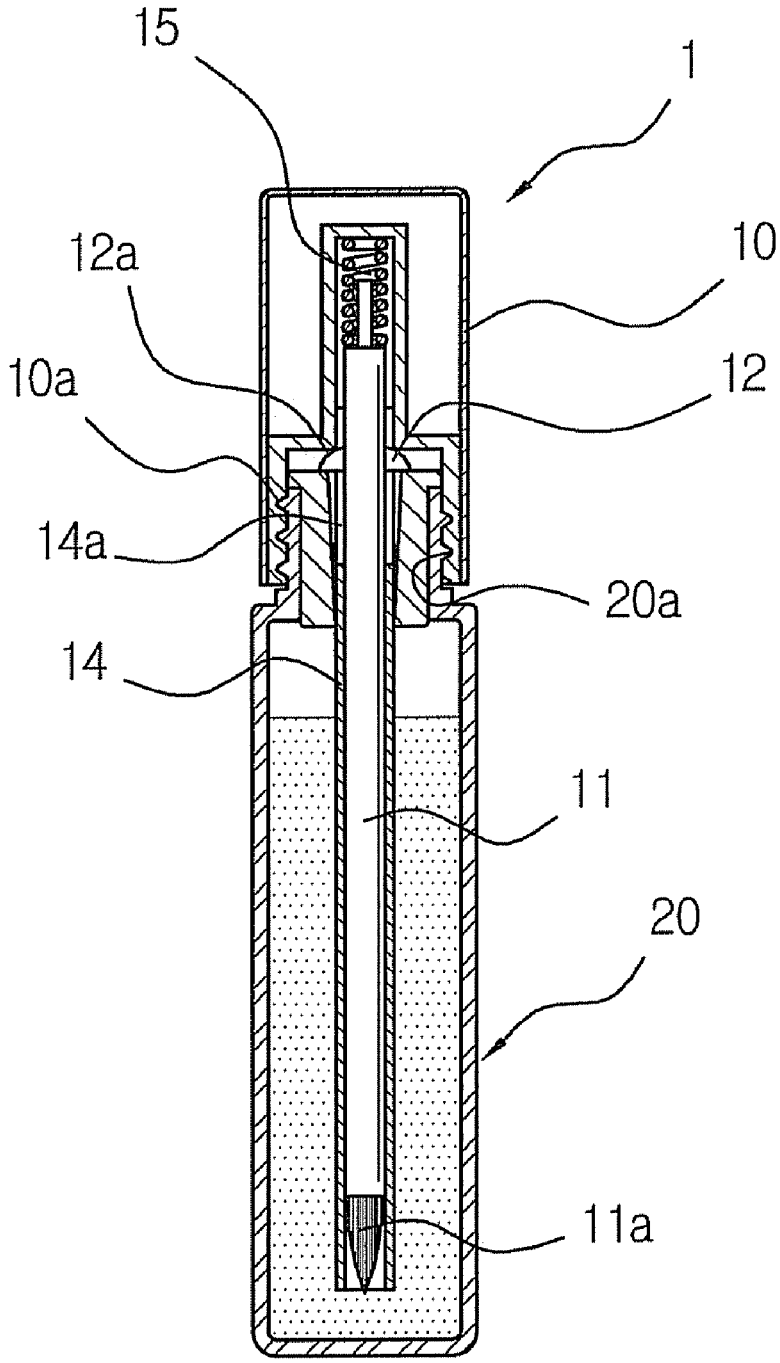

In these state, when the cap 10 is screw-engaged with the inlet of the cosmetic container 20 so as to allow the supporting tube 14 to be inserted through the inlet/outlet hole 21*a* formed on the inner cap 21 of the cosmetic container 20, only the supporting tube 14 is downwardly moved in a state where the latching protrusion 12 of the stem 11 outwardly protruded from the supporting tube 14 is latched by the inner cap 21, to thereby allow the tuft of bristles 11*a* implanted in the lower end of the stem 11 to be partially inserted into the inside of the supporting tube 14, as shown in FIG. 3*b*.

So far, since the supporting tube 14 is merely inserted into the inlet/outlet hole 21*a* of the inner cap 21 to thereby be downwardly moved so that the rotation of the stem 11 is not operated, the twist or tangle of the tuft of bristles 11*a* is not generated at all.

In these state, when the cap 10 is rotated to thereby be screw-engaged with the inlet of the cosmetic container 20, the supporting tube 14 is rotated to thereby be downwardly moved in a state where the stem 11 together with the latching protrusion 12 is latched by the inner cap 21, so that the tuft of bristles 11*a* can be completely inserted and received into the inside of the supporting tube 14.

As a result, since the stem 11 together with the supporting tube 14 are rotated and also the tuft of bristles 11*a* is completely inserted into the inside of the supporting tube 14, the tuft of bristles 11*a* is exposed to the liquid cosmetic for a comparatively short period of time, so that the tangle of the tuft of bristles 11*a* generated due to its twist is effectively prevented to thereby allow a user to precisely apply make-up using the tuft of bristles 11*a* stained with the liquid cosmetic, the cosmetic brush 1 has an advantage in that competitiveness of the cosmetic brush 1 is considerably enhanced.

Further, the tuft of bristles 11*a* is rotated together with the cap 10 in a state where it is received into the inside of the supporting tube 14 when the cap is reversely rotated, so that the tuft of bristles 11*a* is rotated with less resistance against the liquid cosmetic. Thereafter, when the cap 10 is removed from the inlet of the cosmetic container 20, the latching protrusion 12 is removed from the top peripheral edge part of the inner cap 21 to thereby release the latched state, and also the stem 11 is downwardly moved so that the tuft of bristles is protruded out of the lower portion of the supporting tube 14 by a restoration force of the spring 15, to thereby allow the cosmetic brush 1 to be used. Consequently, when the cap 10 is rotated so as to be removed from the cosmetic container 20, the tuft of bristles 11*a* is in contact with the liquid cosmetic for a comparatively short period of time to thereby be hardly affected by the resistance.

Figure 4:
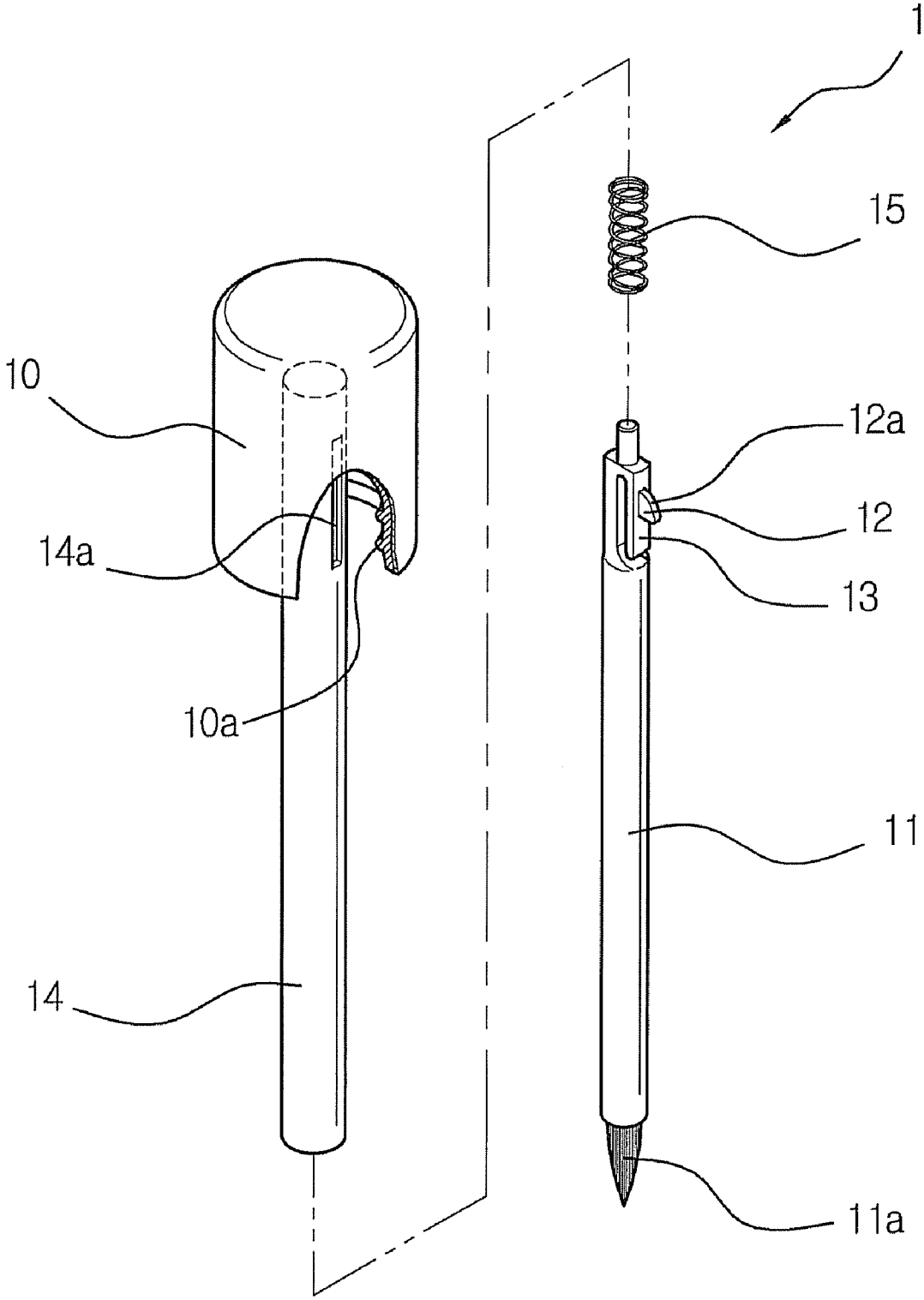
FIG. 4 is an exploded perspective view of another embodiment of the cosmetic brush according to the present invention.
Figure 5:
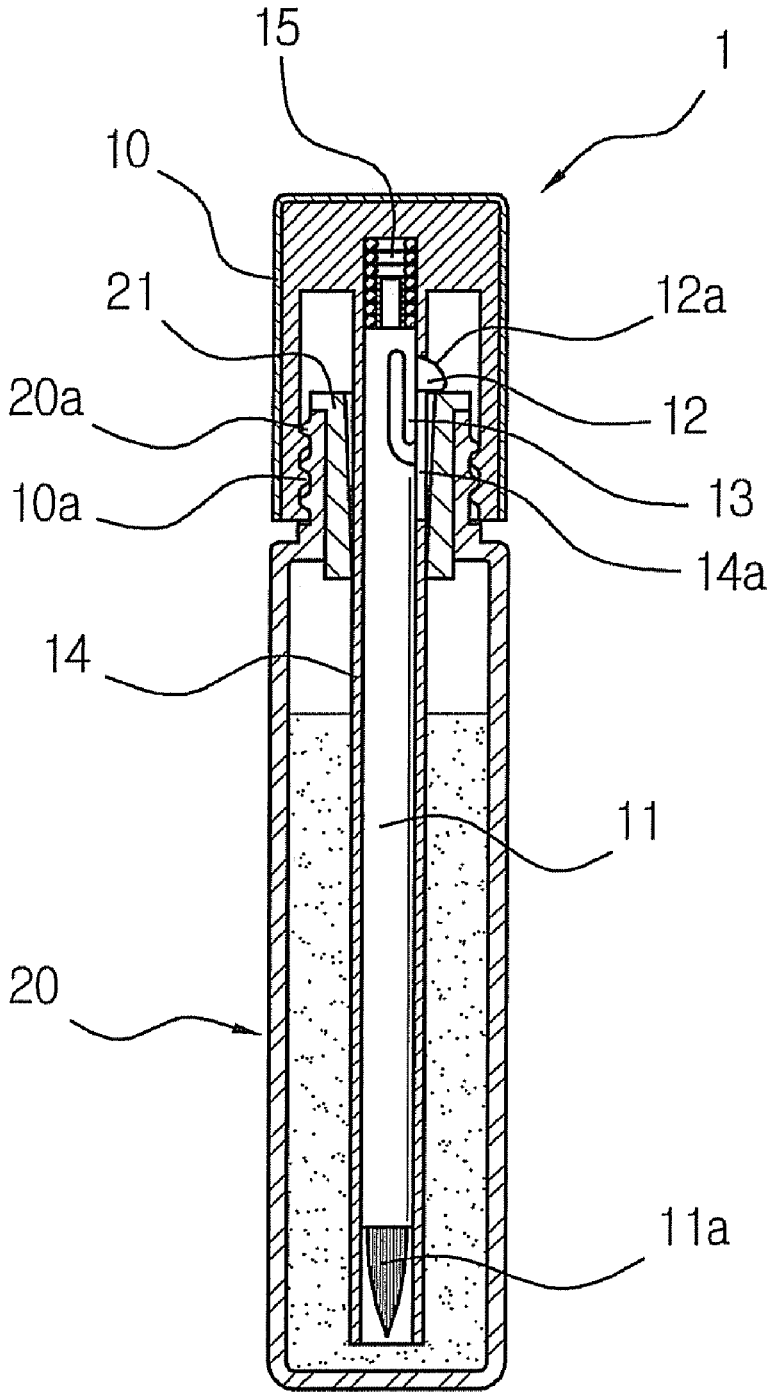
FIG. 5 is an assembly cross-sectional view of FIG. 4.

Meanwhile, as shown in FIGS. 4 and 5, the latching protrusion 12 is outwardly protruded from an elastic piece 13 formed on the upper portion of the stem 11, and has an inclined surface 12*a* formed thereon.

At this time, when the spring 15 is inserted into the inside of the supporting tube 14 and then the elastic piece 13 formed on the upper portion of the stem 11 is inserted into the inside of the supporting tube 14, the inclined surface 12*a* of the latching protrusion 12 is advanced into the inside of the supporting tube 14 while being pressed together with the elastic piece 13. Thereafter, when the latching protrusion 12 is positioned in a guide slit 14*a*, it is outwardly protruded via the guide slit 14*a* by means of an elastic force of the elastic piece 13 so as to be latched by the guide slit 14*a*, so that the stem 11 can be easily assembled into the inside of the supporting tube 14.

Figure 6:
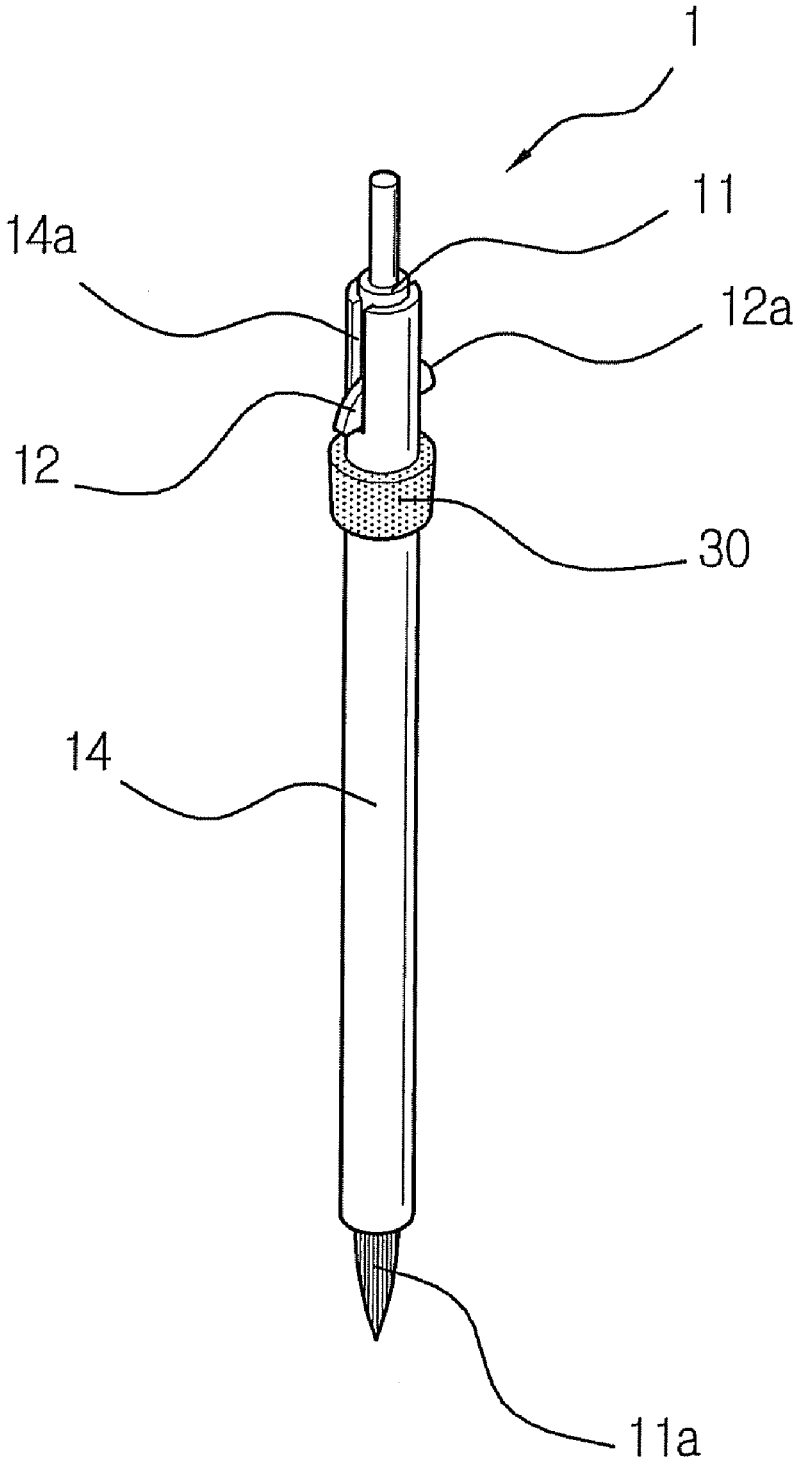
FIG. 6 is an exploded perspective view of another embodiment of the cosmetic brush according to the present invention.
Figure 7:
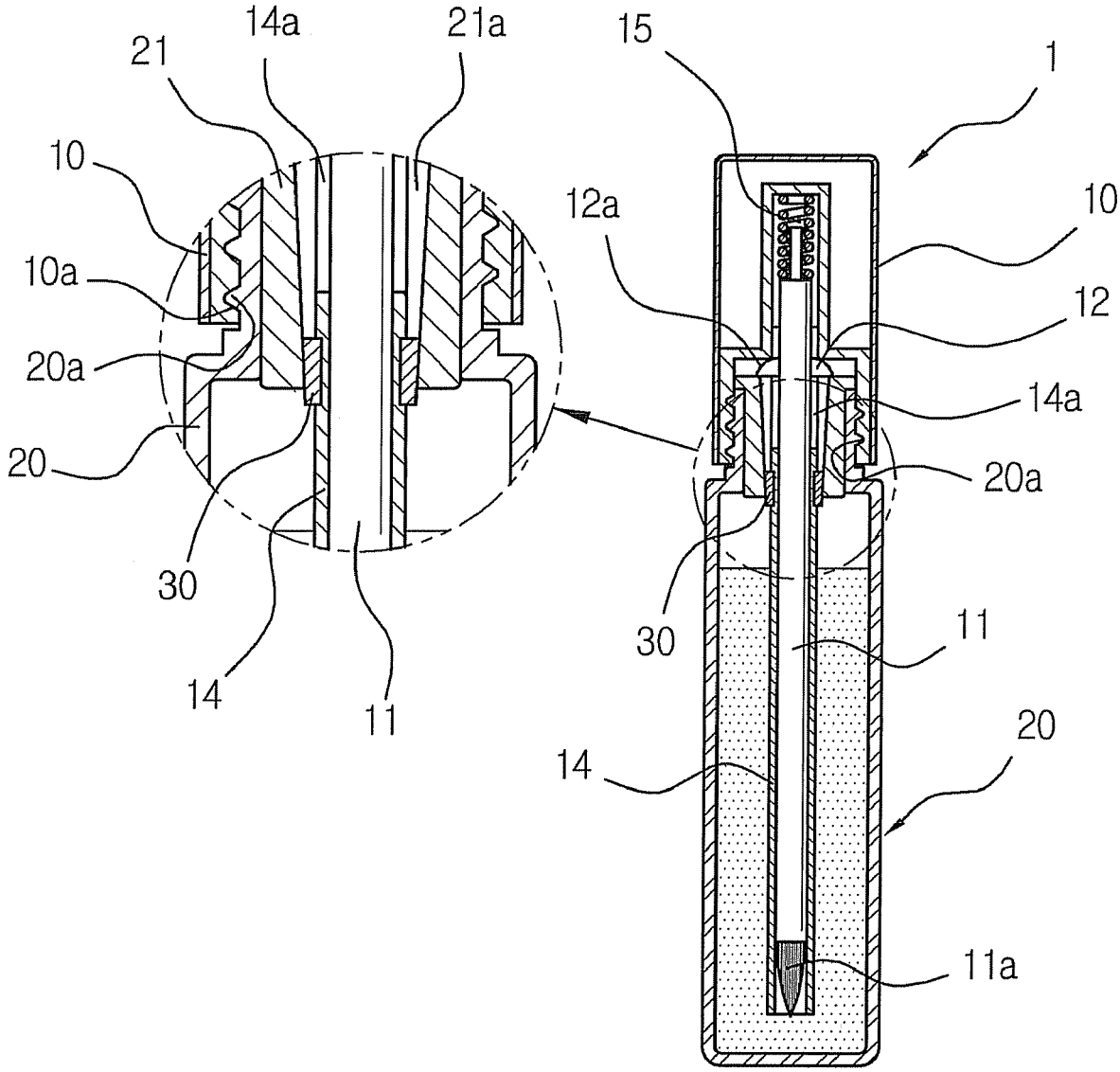
FIG. 7 is an assembly cross-sectional view of FIG. 6.

In addition, as shown in FIGS. 6 and 7, a packing member 30 of a ring type having an elastic force is coupled around the upper portion of the stem 11. In this state, when the stem 11 is inserted through the inlet/outlet hole 21*a* of the inner cap 21, the packing member 30 comes in close contact with the lower portion of the inlet/outlet hole 21*a*, so that an inner compressed air inside of the cosmetic container 20 is prevented from being discharged.

At this time, although the stem 11 is inserted through the inner cap 21 to thereby generate an inner compressed air inside of the cosmetic container 20, the packing member 30 of a ring type is in close contact with the inner circumferential surface of the inner cap 21 to thereby prevent the compressed air from being discharged, so that the pumping effect in which liquid cosmetic is reverse flowed into the upper portion of the cosmetic container 20 together with the compressed air can be effectively prevented, to thereby considerably enhance the competitiveness of the cosmetic container.

As describe above, according to the present invention, when the cap is rotated so as to allow the cap 10 to be screw-engaged or screw-disengaged with/from the cosmetic container 20, only a short length of the tuft of bristles 11*a* is exposed to the liquid cosmetic for a comparatively short period of time so as to be hardly affected by the resistance force against the liquid cosmetic while the tuft of bristles 11*a* is rotated in a state where it is received into the inside of the supporting tube 14, so that the tangle or twist of the tuft of bristles 11*a* can be effectively prevented, to thereby allow a user to precisely apply make-up using the tuft of bristles 11*a* stained with the liquid cosmetic, resulting in considerably increasing the competitiveness of the cosmetic brush 1.

Accordingly, the cosmetic brush 1 according to the present invention has advantages such as where the twist of the tuft of bristles 11*a* is prevented until the liquid cosmetic is completely consumed by considerably improving the tangle or twist of the tuft of bristles 11*a*, to thereby provide a cosmetic brush having high quality to consumers.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A cosmetic brush comprises;

a cylindrical cap;

a supporting tube vertically extended, one end of which is mounted inside of the cylindrical cap;

an upright-standing stem movably received in the supporting tube, the upright-standing stem having a tuft of bristles fixed on a lower end thereof;

a spring disposed inside of the cylindrical cap such that the stem is elastically downwardly biased inside of the supporting tube; and a cosmetic container including a screw thread portion formed on an upper portion thereof, an inner cap mounted at an inner circumference of the screw thread portion and a cylindrical body formed at a lower portion thereof to have a width larger than that of the inner cap, the inner cap having an inlet/outlet hole with a narrow width formed on a top end thereof, wherein the stem comprises a latching protrusion outwardly protrusively formed on an outer peripheral surface of an upper portion thereof, and the supporting tube comprises a guide slit formed longitudinally on an upper portion of the supporting tube to receive the latching protrusion, the elastically downward movement of the stem being stopped by the guide slit when the tuft of bristles is exposed outside of a lower end of the supporting tube, and wherein when the supporting tube is inserted into the container through the inlet/outlet hole by means of the screw-engagement between the cap and the inner cap with each other, the latching protrusion is latched and pushed upwards by the inner cap, to thereby allow the stem and the tuft of bristles to be raised so as to be received inside of the supporting tube.

2. The cosmetic brush according to claim 1, wherein the latching protrusion is outwardly protruded from an elastic piece formed on the upper portion of the stem.

3. The cosmetic brush according to claim 2, wherein the latching protrusion has an inclined surface formed thereon.

4. The cosmetic brush according to claim 1, wherein a ring-shaped packing member having an elastic force is coupled around the upper portion of the stem, and in this state, when the stem is inserted through the inlet/outlet hole of the inner cap, the packing member comes in close contact with the lower portion of the inlet/outlet hole, so that an inner compressed air inside of the cosmetic container is prevented from being discharged to the outside.

* * * * *